US011255551B2

(12) United States Patent
Kim et al.

(10) Patent No.: US 11,255,551 B2
(45) Date of Patent: Feb. 22, 2022

(54) AIR CONDITIONER

(71) Applicant: SAMSUNG ELECTRONICS CO., LTD., Suwon-si (KR)

(72) Inventors: Jin-Gyun Kim, Seongnam-si (KR); Chang-woo Jung, Suwon-si (KR); Weon Seok Choi, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 196 days.

(21) Appl. No.: 16/067,344

(22) PCT Filed: Jan. 2, 2017

(86) PCT No.: PCT/KR2017/000024
§ 371 (c)(1),
(2) Date: Jun. 29, 2018

(87) PCT Pub. No.: WO2017/119689
PCT Pub. Date: Jul. 13, 2017

(65) Prior Publication Data

US 2019/0003727 A1 Jan. 3, 2019

(30) Foreign Application Priority Data

Jan. 7, 2016 (KR) ..... 10-2016-0002135

(51) Int. Cl.
*F24F 1/0014* (2019.01)
*F24F 1/005* (2019.01)
(Continued)

(52) U.S. Cl.
CPC ..... *F24F 1/0014* (2013.01); *F24F 1/005* (2019.02); *F24F 13/08* (2013.01); *F24F 13/12* (2013.01);
(Continued)

(58) Field of Classification Search
CPC ..... F24F 1/0014; F24F 1/005; F24F 13/08; F24F 13/12; F24F 13/20; F24F 1/0029; F24F 1/0033
(Continued)

(56) References Cited

U.S. PATENT DOCUMENTS 3,608,469 A * 9/1971 Mutoh ..... B60S 1/54 454/127
5,964,658 A * 10/1999 Aizawa ..... B60H 1/00692 454/121
(Continued)

FOREIGN PATENT DOCUMENTS

CN 2560894 Y * 7/2003 ..... F24F 13/08
EP 1361398 A1 * 11/2003 ..... F24F 1/0007
(Continued)

OTHER PUBLICATIONS

International Search Report dated Apr. 24, 2017 in corresponding International Patent Application No. PCT/KR2017/000024.
(Continued)

*Primary Examiner* — Avinash A Savani
*Assistant Examiner* — Dana K Tighe
(74) *Attorney, Agent, or Firm* — Staas & Halsey, LLP

(57) ABSTRACT

Disclosed herein is an air conditioner including a main outlet and a plurality of fine outlets provided in a main body, wherein at least one discharge guide for guiding air discharged by a blowing fan to one of the main outlet and the fine outlets is disposed in the inside of the main body to cool indoor space in various ways.

12 Claims, 7 Drawing Sheets

(51) Int. Cl.

| | |
|---|---|
| ***F24F 13/08*** | (2006.01) |
| ***F24F 13/12*** | (2006.01) |
| *F24F 13/20* | (2006.01) |
| *F24F 1/0033* | (2019.01) |
| *F24F 1/0029* | (2019.01) |

(52) U.S. Cl.
CPC ..... *F24F 1/0029* (2013.01); *F24F 1/0033* (2013.01); *F24F 13/20* (2013.01)

(58) Field of Classification Search
USPC ..... 454/233
See application file for complete search history.

(56) References Cited

U.S. PATENT DOCUMENTS

| | | | | |
|---|---|---|---|---|
| 6,530,832 | B2 * | 3/2003 | Elliot | B60H 1/242 454/127 |
| 7,251,953 | B2 * | 8/2007 | Wetzel | F24F 3/161 62/419 |
| 9,109,828 | B2 * | 8/2015 | Delgadillo | F25D 17/067 |
| 9,410,716 | B2 * | 8/2016 | Ryu | F24F 1/0007 |
| 2006/0086138 | A1 * | 4/2006 | Park | F24F 1/0007 62/428 |
| 2014/0097730 | A1 * | 4/2014 | Kim | F24F 13/1486 312/236 |
| 2016/0123605 | A1 * | 5/2016 | Son | F24F 1/0011 165/122 |

FOREIGN PATENT DOCUMENTS

| | | | | |
|---|---|---|---|---|
| EP | 1367336 | A1 * | 12/2003 | F24F 1/0014 |
| EP | 1772678 | A1 * | 4/2007 | F24F 13/10 |
| EP | 2090843 | | 8/2009 | |
| EP | 2518418 | | 10/2012 | |
| EP | 2719969 | | 4/2014 | |
| JP | 63-286649 | | 11/1988 | |
| JP | 2004-176995 | | 6/2004 | |
| JP | 2012-93043 | | 5/2012 | |
| KR | 10-2005-0072249 | | 7/2005 | |
| KR | 10-2014-0037985 | | 3/2014 | |
| KR | 10-2015-0146183 | | 12/2015 | |
| WO | 2007/121684 | | 11/2007 | |

OTHER PUBLICATIONS

Written Opinion of the International Searching Authority dated Apr. 24, 2017 in corresponding International Patent Application No. PCT/KR2017/000024.
Extended European Search Report dated Oct. 31, 2018 in European Patent Application No. 17736062.5.
Chinese Office Action dated Jan. 22, 2020 in Chinese Patent Application No. 201780006037.7.
European Communication dated Sep. 11, 2020 in European Patent Application No. 17736062.5.
Chinese Office Action dated Jul. 14, 2020 in Chinese Patent Application No. 201780006037.7.
Chinese Office Action dated Nov. 4, 2020 in Chinese Patent Application No. 201780006037.7.
Chinese Office Action dated Apr. 14, 2021 in Chinese Patent Application No. 201780006037.7.

* cited by examiner

【Fig. 1】
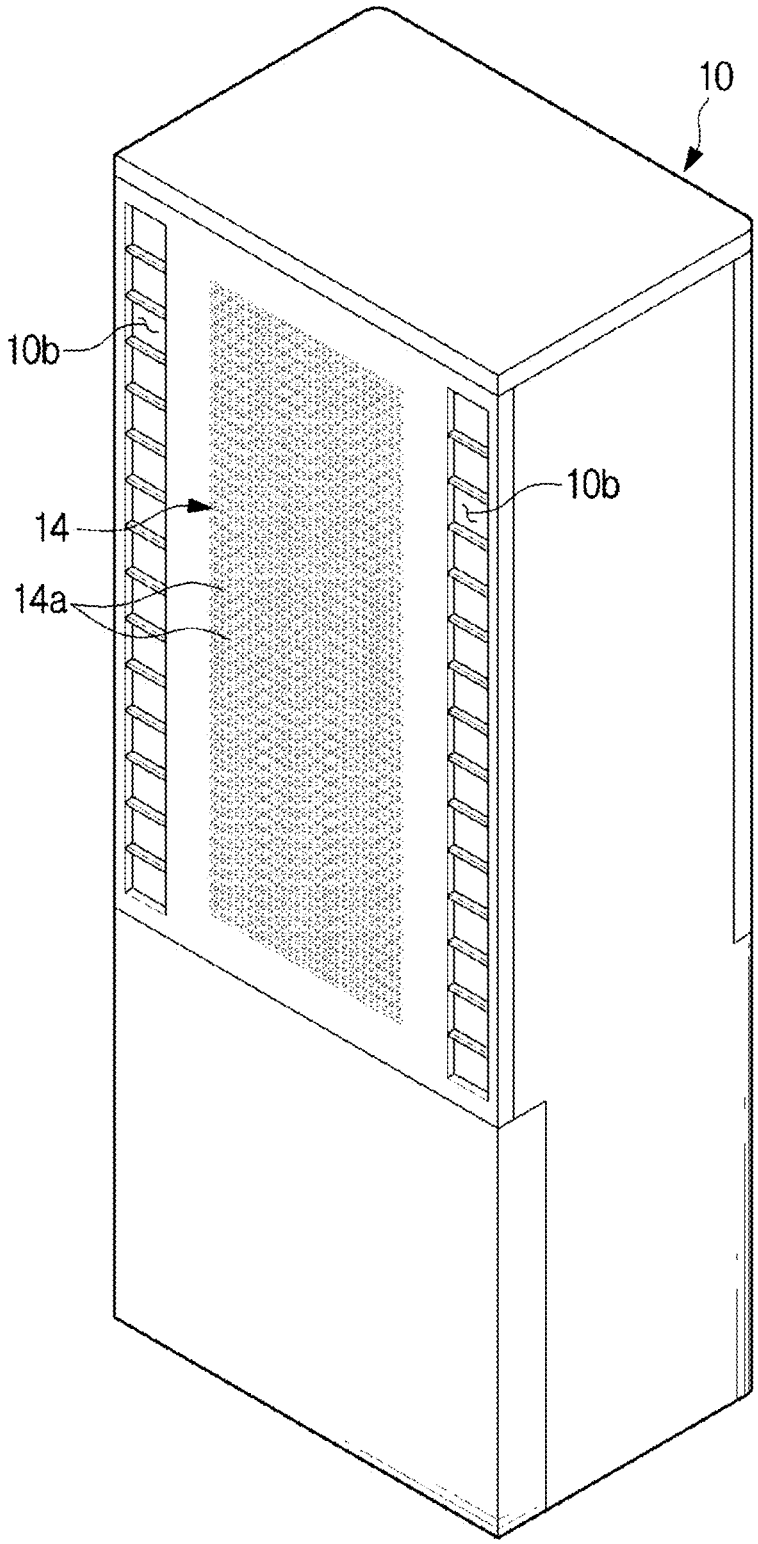

【Fig. 2】
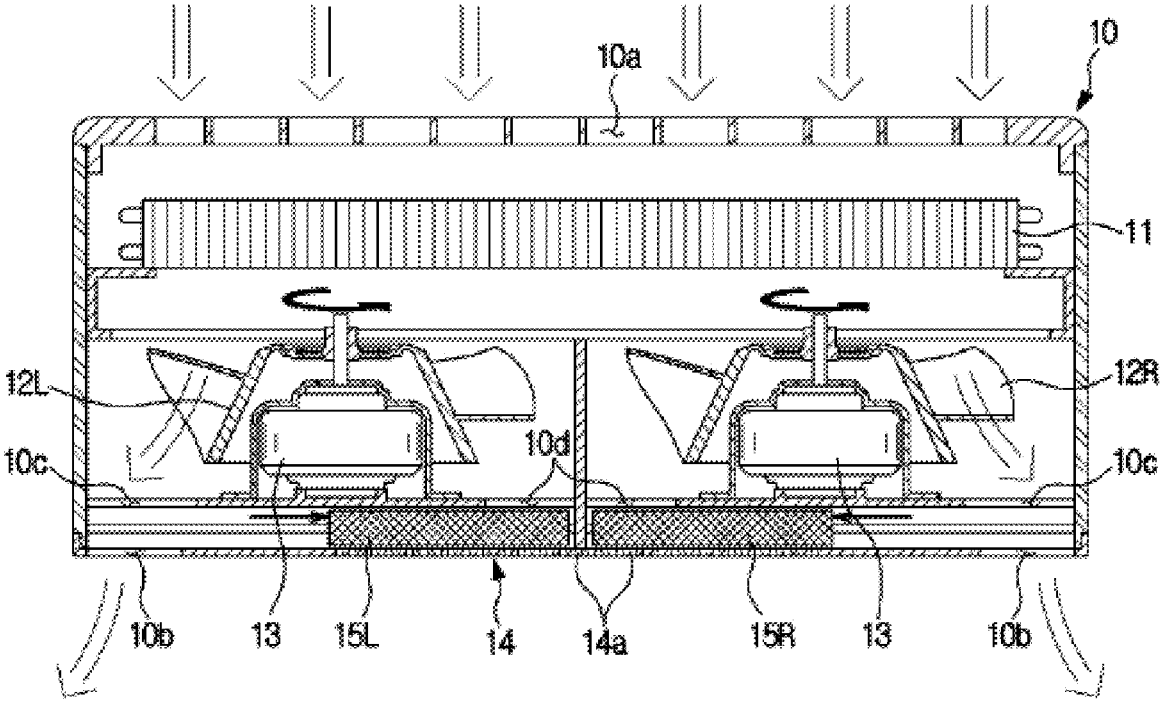

【Fig. 3】
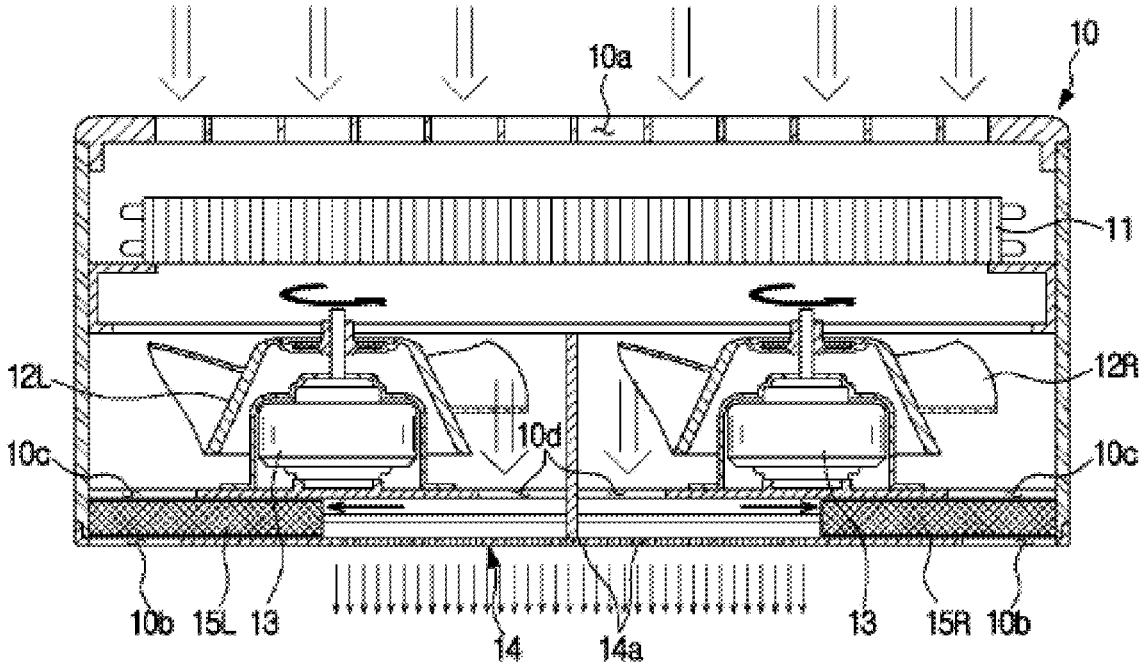

【Fig. 4】
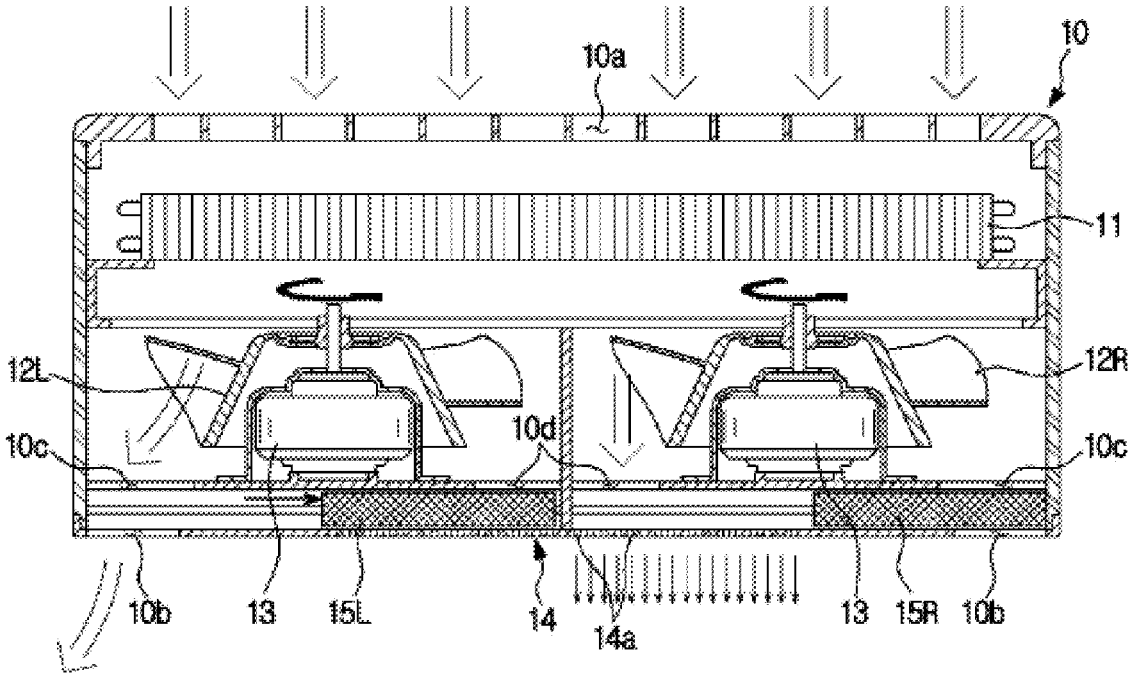

【Fig. 5】
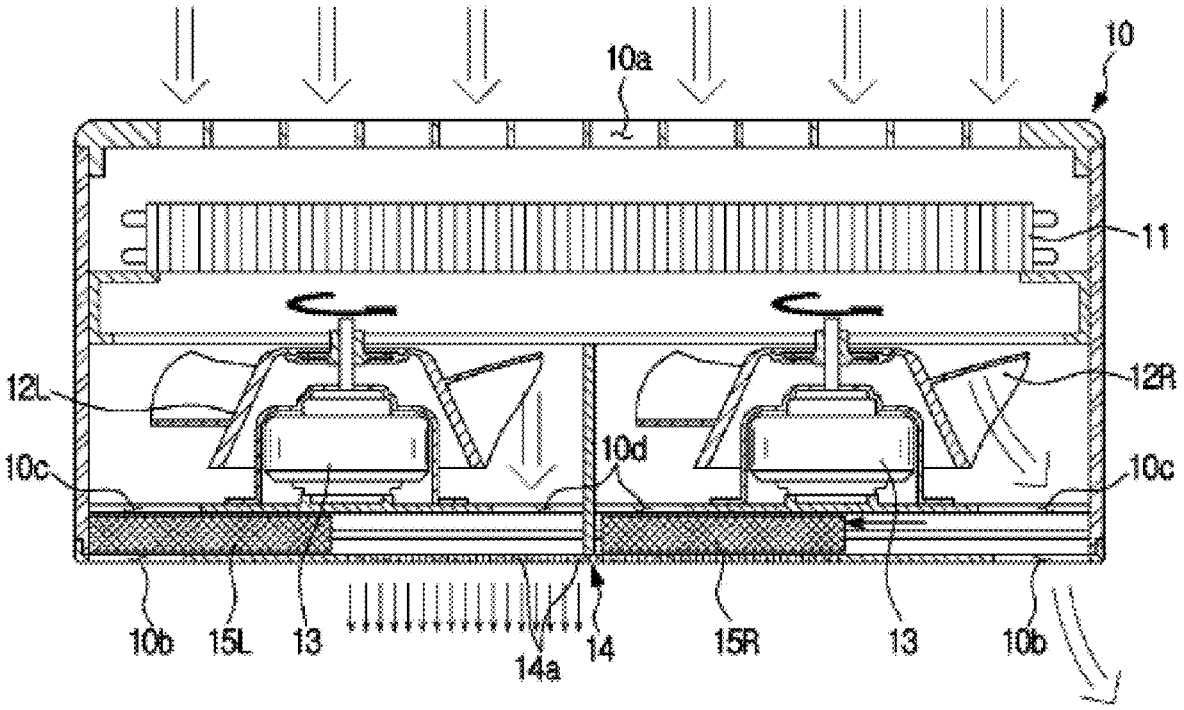

【Fig. 6】
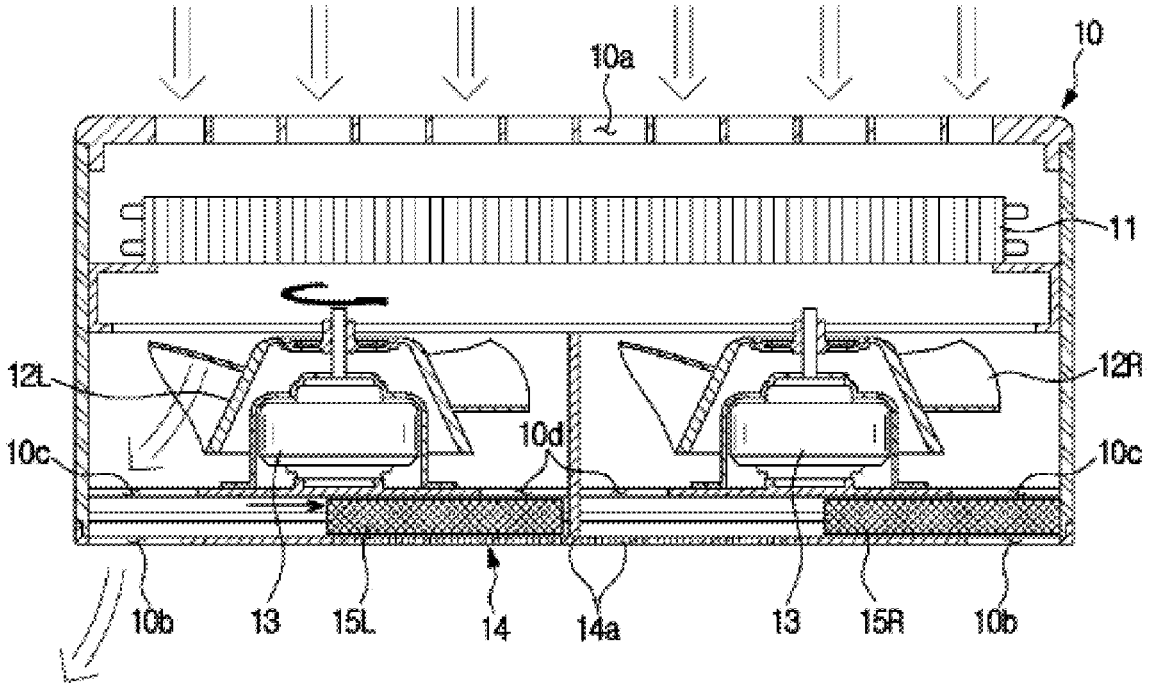

【Fig. 7】
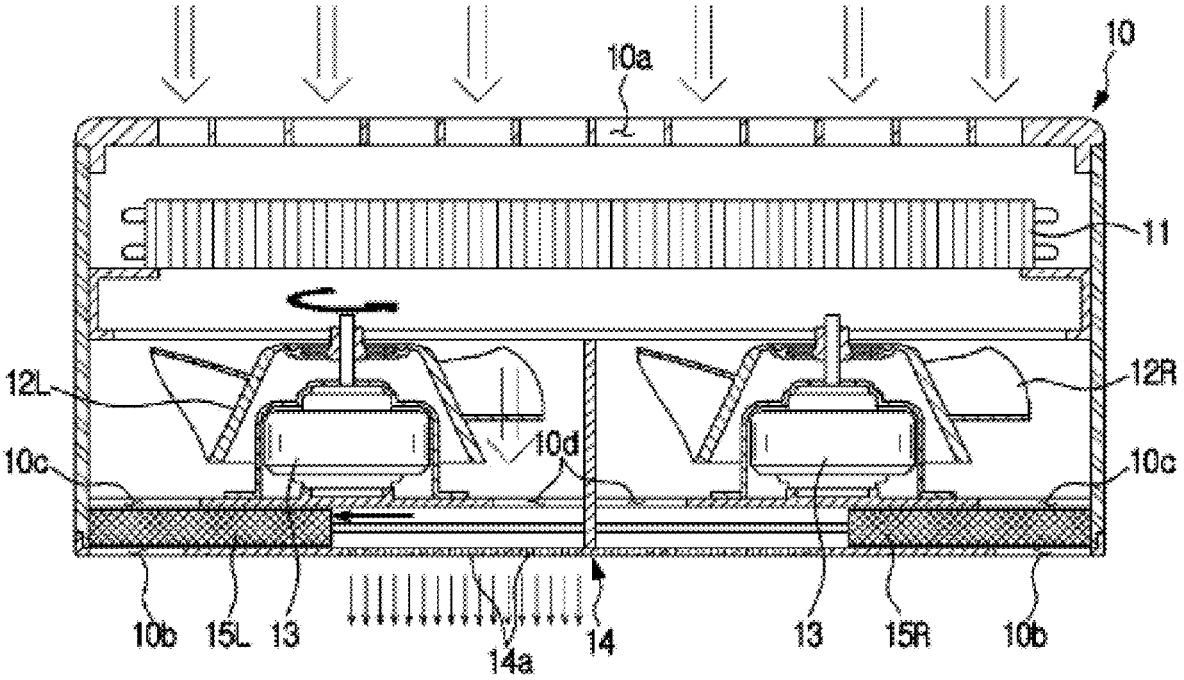

AIR CONDITIONER

CROSS-REFERENCE TO RELATED APPLICATIONS

This application is a National Phase Application under 35 U.S.C. § 371 of PCT International Patent Application No. PCT/KR2017/000024, filed Jan. 2, 2017 which claims the foreign priority benefit under 35 U.S.C. § 119 to Korean Patent Application No. 10-2016-0002135 filed Jan. 7, 2016, the contents of which are incorporated herein by reference.

TECHNICAL FIELD

The present disclosure relates to an air conditioner including fine outlets through which air is discharged at very low speed.

BACKGROUND ART

In general, an air conditioner generates cold air or warm air through a refrigerating cycle, and supplies the cold air or warm air to indoor space to cool or heat the indoor space.

Recently, an air conditioner having an outlet panel provided with fine outlets of very small sizes to discharge air at very low speed so as to cool indoor space while preventing cold air discharged from the air conditioner from directly reaching a user's skin has been developed.

DISCLOSURE

Technical Problem

In accordance with an aspect is to provide an air conditioner capable of discharging air in various ways.

Technical Solution

In accordance with one aspect of the present disclosure, an air conditioner including a main body, at least one blowing fan disposed in the main body, at least one main outlet provided in the main body, a plurality of fine outlets provided in the main bod, and at least one discharge guide configured to guide air discharged from the blowing fan to one of the main outlet and the fine outlets.

The main body may include a first flow path configured to guide refrigerant discharged from the blowing fan to the main outlet, and a second flow path configured to guide the refrigerant discharged from the blowing fan to the fine outlets, and wherein the discharge guide moves to selectively open the first flow path and the second flow path.

The main body may include an outlet panel disposed on a front side of the main body and provided with the fine outlets, wherein the at least one main outlet comprises a pair of main outlets provided in both sides of the main body, and wherein the at least one discharge guide comprises a pair of discharge guides for opening and closing the pair of main outlets respectively.

The at least one blowing fan comprises a pair of blowing fans respectively corresponding to the pair of main outlets.

In accordance with another aspect of the present disclosure, an air conditioner including a main body provided with a pair of main outlets, an outlet panel disposed between the pair of main outlets and provided with a plurality of fine outlets, a pair of blowing fans disposed in the main body, and a pair of discharge guides configured to guide air discharged from the pair of blowing fans to one of the pair of main outlets and the fine outlets.

Advantageous Effects

As described above, the air conditioner according to one aspect of the present disclosure may guide air discharged from the blowing fan to one(s) of the main outlet and the fine outlets through the discharge guide so as to discharge the air at high speed through the main outlet or at very low speed through the fine outlets.

Also, since the air conditioner includes the pair of main outlets, the air conditioner may cool left and right space in different ways or cool one of the left and right spaces.

DESCRIPTION OF DRAWINGS

FIG. 1 is a perspective view illustrating an air conditioner according to an embodiment of the present disclosure, FIG. 2 is a plan sectional view illustrating a case air is discharged through a main outlet in air conditioner according to the embodiment of the present disclosure, FIG. 3 is a plan sectional view illustrating a case in which the air is discharged through fine outlets in the air conditioner according to the embodiment of the present disclosure, FIGS. 4 and 5 are plan sectional views illustrating cases in which one side of the main body discharges air through the main outlet and the other side of the main body discharges air through the fine outlets in the air conditioner according to the embodiment of the present disclosure, FIG. 6 is a plan sectional view illustrating a case in which air is discharged only through the main outlet provided on one side of the main body in the air conditioner according to the embodiment of the present disclosure, FIG. 7 is a plan sectional view illustrating a case in which air is discharged only through a fine outlets provided at one side of an outlet panel in the air conditioner according to the embodiment of the present disclosure.

MODE FOR INVENTION

An air conditioner apparatus for cooling or heating indoor space through a refrigerating cycle. In the current embodiment, an air conditioner for cooling will be described as an example.

The refrigerating cycle used in the air conditioner may include a compressor for compressing refrigerant at a high temperature, high pressure state, a condenser for cooling and condensing the refrigerant compressed by the compressor by air, an expansion valve for decompressing and expanding the refrigerant condensed by the condenser, and an evaporator for causing the refrigerant expanded by the expansion valve to absorb heat from air to evaporate.

The air conditioner may include an outdoor unit disposed in outdoor space and an indoor unit disposed in indoor space. The outdoor unit may include the compressor, the condenser, the expansion valve, and an outdoor blowing fan for heat-exchanging outdoor air with refrigerant passing through the condenser. The indoor unit may include the evaporator, and an indoor blowing fan for heat-exchanging the indoor air with refrigerant passing through the evaporator.

The air conditioner may cool the indoor space by supplying low-temperature air cooled by the evaporator to the indoor space.

Hereinafter, an air conditioner according to an embodiment of the present disclosure will be described in detail with reference to the drawings.

Referring to FIGS. 1 and 2, an air conditioner according to an embodiment of the present disclosure may include a main body 10 forming an outer appearance of the air conditioner, an evaporator 11 disposed on an inner rear side of the main body 10 to heat-exchange air inhaled into the main body 10 to cool the air, blowing fans 12L and 12R for inhaling and blowing air by rotating to inhale air into the main body 10 and then discharge the air to the outside of the main body 10, and a driving motor 13 for driving the blowing fans 12L and 12R.

The main body 10 may include an inlet 10*a* for inhaling air in the rear side, and main outlets 10*b* for discharging air blown by the blowing fans 12L and 12R to the outside of the main body 10 in the both sides.

In the center of the front portion of the main body, an outlet panel 14 may be disposed to discharge air, at very low speed. The outlet panel 14 may include fine outlets 14*a* having very small sizes. Since air delivered to the outlet panel 14 has very low speed while passing through the fine outlets 14*a*, air discharged through the outlet panel 14 may not directly reach a users skin.

In the inside of the main body 10, a first flow path 10*c* for guiding air blown by the blowing fans 12L and 12R to the main outlet 10*b*, and a second flow path 10*b* for blowing air blown by the blowing fans 12L and 12R to the fine outlets 14*a* may be provided. Two first flow paths 10*c* may be provided to correspond to the two main outlets 10*b*, respectively, and two second flow paths 10*d* may be provided to correspond to the left and right sides of the outlet panel 14.

Also, in the inside of the main body 10, a pair of discharge guides 15L and 15R for selectively opening one of the first flow path 10*c* and the second flow path 10*d* so as to discharge air through one(s) of the main outlet 10*b* and the fine outlets 14*a* may be disposed. The discharge guides 15L and 15R may be movably installed in the main body 10. The discharge guides 15L and 15R may move by power received from a motor (not shown) to open one of the first flow path 10*c* and the second flow path 10*d* and close the other one of the first flow path 10*c* and the second flow path 10*d*.

The blowing fans 12L and 12R may include a first blowing fan 12L corresponding to the first flow path 10*c* and the second flow path 10*d* disposed in the left side of the main body 10, and a second blowing fan 12R corresponding to the first flow path 10*c* and the second flow path 10*d* disposed in the right side of the main body 10. Air blown by the first blowing fan 12L may be discharged through one of the first flow path 10*c* and the second flow path 10*d* provided in the left side of the main body 10, and air blown by the second blowing fan 12R may be discharged through one, of the first flow path 10*c* and the second flow path 10*d* provided in the right side of the main body 10.

Hereinafter, an operation of the air conditioner according to the present disclosure will be described in detail with reference to the drawings.

First, when the air conditioner discharges air at normal speed, the discharge guides 15L and 15R may move to open the first flow paths 10*c* and to close the second flow paths 10*d*, as shown in FIG. 2.

In this state, air blown by the blowing fans 12L and 12R may pass through the first flow path 10*c*, and be discharged to indoor space through the two main outlets 10*b*.

Next, when the air conditioner discharges air at very low speed, the discharge guides 15L and 15R may move to open the second paths 10*d* and to close the first flow paths 10*c*, as shown in FIG. 3.

In this state, air blown by the blowing fans 12L and 12R may pass through the second flow path 10*d* to be delivered to the two outlet panels 14, and then discharged at very low speed through the fine outlets 14*a* formed in the outlet panel 14.

In addition, the air conditioner may cool left and right space in different ways.

Referring to FIG. 4, the discharge guide 15L provided in the left side may open the first flow path 10*c* and close the second flow path 10*d*, and the discharge guide 15R provided in the right side may open the second flow path 10*d* and close the first flow path 10*c*.

When the discharge guides 15L and 15R move in this way, air of normal speed may be discharged to the left, front space of the main body 10 through the first flow path 10*c* and the main outlet 10*b*, and air of very low speed may be discharged to the right, front space of the main body 10 through the second flow path 10*d* and the fine outlets 14*a*.

On the contrary, the discharge guide 15R provided in the right side may open the first flow path 10*c* and close the second flow path 10*d*, and the discharge guide 15L provided in the left side may open the second flow path 10*d* and close the first flow path 10*c*, as shown in FIG. 5.

Accordingly, air having sufficient flow speed may be discharged through the main outlet 10*b* to space where no user exists so as to cool indoor space quickly, and air having very low speed may be discharged through the fine outlets 14*a* toward the other space where a user exists so as to prevent cold air from directly reaching the user's skin.

In addition, one side of the indoor space may be cooled by air discharged from the main outlet 10*b*, as shown in FIG. 6, or one side of the indoor space may be cooled by air discharged from the fine outlets 14*a*, as shown in FIG. 7.

In the current embodiment, two blowing fans 12L and 12R may be provided to correspond to the two main outlets 10*b*. This is to more efficiently discharge air through the two main outlets 10*b*, but the present disclosure is not limited thereto. It is also possible that the air conditioner includes a single blowing fan to blow air and discharge it through the two main outlets.

In the current embodiment, the pair of the main outlets 10*b* and the pair of discharge guides 15L and 15R may be provided. This is to divide indoor space to two space with respect to the main body 10 and then cool the divided space individually, but the present disclosure not limited thereto. It is also possible that the main body of the air conditioner includes a single main outlet and a single discharge guide.

Although a few embodiments of the present disclosure have been shown and described, it would be appreciated by those skilled in the art that changes may be made in these embodiments without departing from the principles and spirit of the disclosure, the scope of which is defined in the claims and their equivalents.

The invention claimed is:

1. An air conditioner comprising:

a main body having a front part, a rear part, and side parts to form the main body, the front part having:

a main outlet formed therein; and a plurality of fine outlets formed therein and adjacent to the main outlet;

a blowing fan disposed in the main body; and a discharge guide disposed in the front part and configured to guide air discharged from the blowing fan to one of the main outlet and the plurality of fine outlets, wherein the discharge guide is configured to translate slidably to open the main outlet to guide the air discharged from the blowing fan while closing the plurality of fine outlets or to translate slidably to open the plurality of fine outlets to guide the air discharged from the blowing fan while closing the main outlet.

2. The air conditioner according to claim 1, wherein the main body comprises a first flow path configured to guide the air discharged from the blowing fan to the main outlet, and a second flow path configured to guide the air discharged from the blowing fan to the plurality of fine outlets, and wherein the discharge guide is configured to selectively open one of the first flow path and the second flow path while closing an other one of the first flow path and the second flow path.

3. The air conditioner according to claim 1, wherein the front part of the main body comprises an outlet panel and the outlet panel includes the plurality of fine outlets.

4. The air conditioner according to claim 1, wherein when the discharge guide translates slidably to close the main outlet, the plurality of fine outlets are opened by the discharge guide, and when the discharge guide translates slidably to close the plurality of fine outlets, the main outlet is opened by the discharge guide.

5. The air conditioner according to claim 1, wherein the discharge guide includes a first discharge guide and a second discharge guide, the main outlet includes a first main outlet and a second main outlet, and the a plurality of fine outlets includes first fine outlets disposed adjacent to the first main outlet and second fine outlets disposed adjacent to the second main outlet, and wherein the first discharge guide is configured to translate slidably to open one of the first main outlet and the first fine outlets to guide the air discharged from the blowing fan while closing an other one of the first main outlet and the first fine outlets, and the second discharge guide is configured to slidably translate to open one of the second main outlet and the second fine outlets to guide the air discharged from the blowing fan while closing an other one of the second main outlet and the second fine outlets.

6. The air conditioner according to claim 5, wherein the blowing fan includes a first blowing fan and a second blowing fan, and wherein the first discharge guide is configured to guide air discharged from the first blowing fan to one of the first main outlet and the first fine outlets, and the second discharge guide is configured to guide air discharged from the second blowing fan to one of the second main outlet and the second fine outlets.

7. The air conditioner according to claim 5, wherein the first main outlet is disposed on one side of the front part of the main body and the second main outlet is disposed on an opposite side of the front part of the main body, and the first fine outlets and the second fine outlets are disposed between the first main outlet and the second main outlet.

8. The air conditioner according to claim 7, wherein the blowing fan comprises a first blowing fan and a second blowing fan, and the first discharge guide is configured to guide air discharged from the first blowing fan to one of the first main outlet and the first fine outlets, and the second discharge guide is configured to guide air discharged from the second blowing fan to one of the second main outlet and the second fine outlets.

9. The air conditioner according to claim 1, wherein each of the plurality of fine outlets is significantly smaller than the main outlet so that a speed of air discharged from the main outlet is significantly higher than a speed of air discharged from the plurality of fine outlets.

10. An air conditioner comprising:

a main body having a front part, a rear part, and side parts to form the main body the front part having:

a first main outlet and a second main outlet formed in the front part of the main body; and a first fine outlets and a second fine outlets formed between the first main outlet and the second main outlet and disposed adjacent to the first main outlet and the second main outlet, respectively;

a first blowing fan and a second flowing fan disposed in the main body; and a first discharge guide disposed in the front part and configured to respectively guide air discharged from the first blowing fan to one of the first main outlet and the first fine outlets; and a second discharge guide disposed in the front part and configured to respectively guide air discharged from the second blowing fan to one of the second main outlet and the second fine outlets, wherein the first discharge guide is configured to translate slidably to open one of the first main outlet and the first fine outlets to guide the air discharged from the first blowing fan while closing an other one of the first main outlet and the first fine outlets, and the second discharge guide is configured to translate slidably to open one of the second main outlet and the second fine outlets to guide the air discharged from the second blowing fan while closing an other one of the second main outlet and the second fine outlets.

11. The air conditioner according to claim 10, wherein the main body comprises a pair of first flow paths configured to guide the air discharged from the first blowing fan and the second blowing fan to the first main outlet and the second main outlet, respectively, and a pair of second flow paths configured to guide the air discharged from the first blowing fan and the second blowing fan to the first fine outlets and the second fine outlets, respectively, and wherein the first discharge guide and the second discharge guide are configured to selectively open one of the pair of first flow paths and the pair of second flow paths while closing an other one of the pair of first flow paths and the pair of second flow paths, respectively.

12. The air conditioner according to claim 10, wherein each of the first fine outlets and the second fine outlets is significantly smaller than each of the first main outlet and the second main outlet so that a speed of air discharged from the first main outlet and the second main outlet is significantly higher than a speed of air discharged from the first fine outlets and the second fine outlets.

* * * * *